US007074048B2

(12) United States Patent
Liao et al.

(10) Patent No.: US 7,074,048 B2
(45) **Date of Patent: *Jul. 11, 2006**

(54) LAND GRID ARRAY SOCKET HAVING TERMINALS WITH SPRING ARMS

(75) Inventors: Fang-Jwu Liao, Tu-Chen (TW); Ming-Lun Szu, Tu-Chen (TW); Genn-Sheng Lee, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/969,382

(22) Filed: Oct. 19, 2004

(65) Prior Publication Data

US 2005/0054218 A1 Mar. 10, 2005

Related U.S. Application Data

(63) Continuation-in-part of application No. 10/896,121, filed on Jul. 20, 2004, now Pat. No. 6,887,114, which is a continuation-in-part of application No. 10/894,735, filed on Jul. 19, 2004, which is a continuation-in-part of application No. 10/625,237, filed on Jul. 22, 2003, now Pat. No. 6,805,561.

(30) Foreign Application Priority Data

Jun. 11, 2004 (TW) ..... 93303501
Sep. 24, 2004 (TW) ..... 93128971 A

(51) Int. Cl.
*H01R 12/00* (2006.01)

(52) U.S. Cl. ..... 439/66; 862/630

(58) Field of Classification Search ..... 439/66, 439/71, 81–83, 591, 884, 862
See application file for complete search history.

(56) References Cited

U.S. PATENT DOCUMENTS

| | | | | |
|---|---|---|---|---|
| 6,186,797 | B1 * | 2/2001 | Wang et al. | 439/66 |
| 6,375,474 | B1 * | 4/2002 | Harper et al. | 439/66 |
| 6,561,817 | B1 * | 5/2003 | Ma | 439/66 |
| 6,652,329 | B1 * | 11/2003 | Howell et al. | 439/862 |
| 6,695,624 | B1 * | 2/2004 | Szu | 439/66 |
| 6,733,303 | B1 * | 5/2004 | Maldonado et al. | 439/66 |
| 6,805,561 | B1 * | 10/2004 | Walkup et al. | 439/66 |
| 6,887,114 | B1 * | 5/2005 | Liao | 439/862 |
| 6,905,343 | B1 * | 6/2005 | Neidich | 439/66 |

* cited by examiner

*Primary Examiner*—Ross Gushi
*Assistant Examiner*—Larisa Tsukerman
(74) *Attorney, Agent, or Firm*—Wei Te Chung

(57) ABSTRACT

A land grid array socket is provided which includes an insulative housing (22) having a plurality of passageways (24) each accommodating an electrical terminal (1) therein. Contacting ends (134) of the terminal in a same row of the passageways all extend along a predetermined lateral direction, and because of bend of a bending portion (132) in the terminal, the contacting end of the terminal in one passageway does not overlap with another terminal in an adjacent passageway along a vertical direction so as to avoid short circuit risk therebetween.

19 Claims, 5 Drawing Sheets

LAND GRID ARRAY SOCKET HAVING TERMINALS WITH SPRING ARMS

CROSS REFERENCE TO RELATED APPLICATION

This application is a continuation-in-part of U.S. patent application Ser. No. 10/625,237, filed on Jul. 22, 2003 now U.S. Pat. No. 6,805,561, entitled "ELECTRICAL SOCKET HAVING TERMINALS WITH ELONGATED MATING BEAMS", a continuation-in-part of U.S. patent application Ser. No. 10/894,735 filed on Jul. 19, 2004, entitled "ELECTRICAL CONNECTOR WITH DUAL-FUNCTION HOUSING PROTRUSIONS", a continuation-in-part of U.S. patent application Ser. No. 10/896,121, filed on Jul. 20, 2004 now U.S. Pat. No. 6,887,114, entitled "ELECTRICAL CONNECTOR WITH HIGH PERFOMANCE CONTACTS", all of which have the same assignee.

BACKGROUND OF THE INVENTION

1. Field of the Invention

The present invention relates to the art of electrical connectors, and more particularly to a land grid array (LGA) socket having terminals with elongated resilient mating arms.

2. The Related Art

It is well know that a land grid array (LGA) socket basically comprises an insulative housing having a plurality of passageways arrayed thereof, each passageway has an electrical terminal accommodated therein to electrically connect two separate electronic components via mating beams of the terminal. With the trend toward miniaturization in computer technology, the LGA sockets are becoming smaller and smaller while the density of the terminals arrayed in the housing are becoming bigger and bigger. Due to the small size of the terminals, the mating beams are easily damaged because of large stress generated during mating of the beams with the electronic components. One solution is disclosed in U.S. Pat. Nos. 6,186,797 and 6,132,220. The arrangement of the terminals with respect to a base of an insulative housing of the socket is modified. In an electrical socket as disclosed in U.S. Pat. No. 6,186,797, a base plate of the socket defines an array of terminal holes arranged in a lattice-like array for receiving corresponding terminals therein. Respective rows of the terminal holes are oriented at a same angle, preferably 45 degrees, with respect to sides of the base plate. In this way, not only is miniaturization of the pitch of adjacent terminals enhanced, but also the performance of the terminals is improved. However, as disclosed in FIGS. 6 and 7, when the electronic component is fully pressed down to the insulative housing, mating beams of the terminals are completely pressed into the terminal holes, length of the mating beams is relatively short, which can not provide sufficient resilient mating force as required.

Solution to the above shortcomings is disclosed in prior filed U.S. patent application Ser. No. 10/625,237, as shown in FIG. 6 of the patent application, a mating beam of a terminal extends toward an adjacent terminal with a free end of the mating beam being located above a mating beam of the adjacent terminal. This kind of configuration not only elongate the length of the mating beam so as to provide sufficient resilient force, but also make full use of the space between two adjacent passageways so as to increase the density of the terminals arrayed in the housing. However, as shown in FIGS. 8 and 9, when the mating beams of the two adjacent terminal are fully pressed down to their final positions, short circuit between two adjacent terminals might become possible if the mating beams of the terminals contact with each others, this kind of risk is unacceptable because it will badly destroy the electronic components connected with the LGA socket.

Therefore, it would be very beneficial to design an improved LGA socket having terminals which can not only provide sufficient resilient force but also avoid short circuit risk between adjacent terminals.

SUMMARY OF THE INVENTION

Accordingly, a main object of the present invention is to provide an land grid array (LGA) socket having electrical terminals, wherein the terminals enhance the safety of electrical connection between separate electronic components while maintaining a high density array in the socket.

To fulfill the above-mentioned object, a LGA socket in accordance with the present invention comprises an insulative housing having a plurality of passageways formed therein, the passageways are arrayed in several rows in a lateral direction and each have an electrical terminal accommodate therein. The terminal each has a base portion for securing the terminal in the passageway, a solder portion extending toward a bottom mounting surface of the insulative housing and a spring arm extending out of a top mating surface of the insulative housing. The spring arm is connected to the base portion via a connecting portion formed therebetween. The spring arm has an extending portion which extends upwardly in a essentially slant manner with respect to the base portion and has a bending portion formed at one end of the extending portion, and an extending direction of the bending portion is not parallel to an extending direction of the extending portion, i.e. there is an angle existed between the extending directions of the two different portion. Further, a contacting end is formed at one end of the bending portion. An extending direction of the contacting end is parallel to the extending direction of the extending portion. Thus, when the terminals are secured into corresponding passageways of the insulative housing, a contacting end of a terminal extends out of its passageway and extends along the lateral direction toward an adjacent passageway in a same row. The contacting end invades a space above the adjacent passageway, and because of bending of the bending portion, the contacting end does not completely locate right above the spring arm of the terminal in the adjacent passageway, but locates in the space beside the adjacent passageway, i.e. the two adjacent terminals do not overlap in a vertical direction. Therefore, when the terminals are pressed down to their final position, the contacting end in one passageway does not contact with the terminal in an adjacent passageway in the same row so as to avoid short circuit risk between the adjacent terminals.

DETAILED DESCRIPTION OF PREFERRED EMBODIMENT

Reference will now be made to the drawings to describe the present invention in detail.

Figure 1:
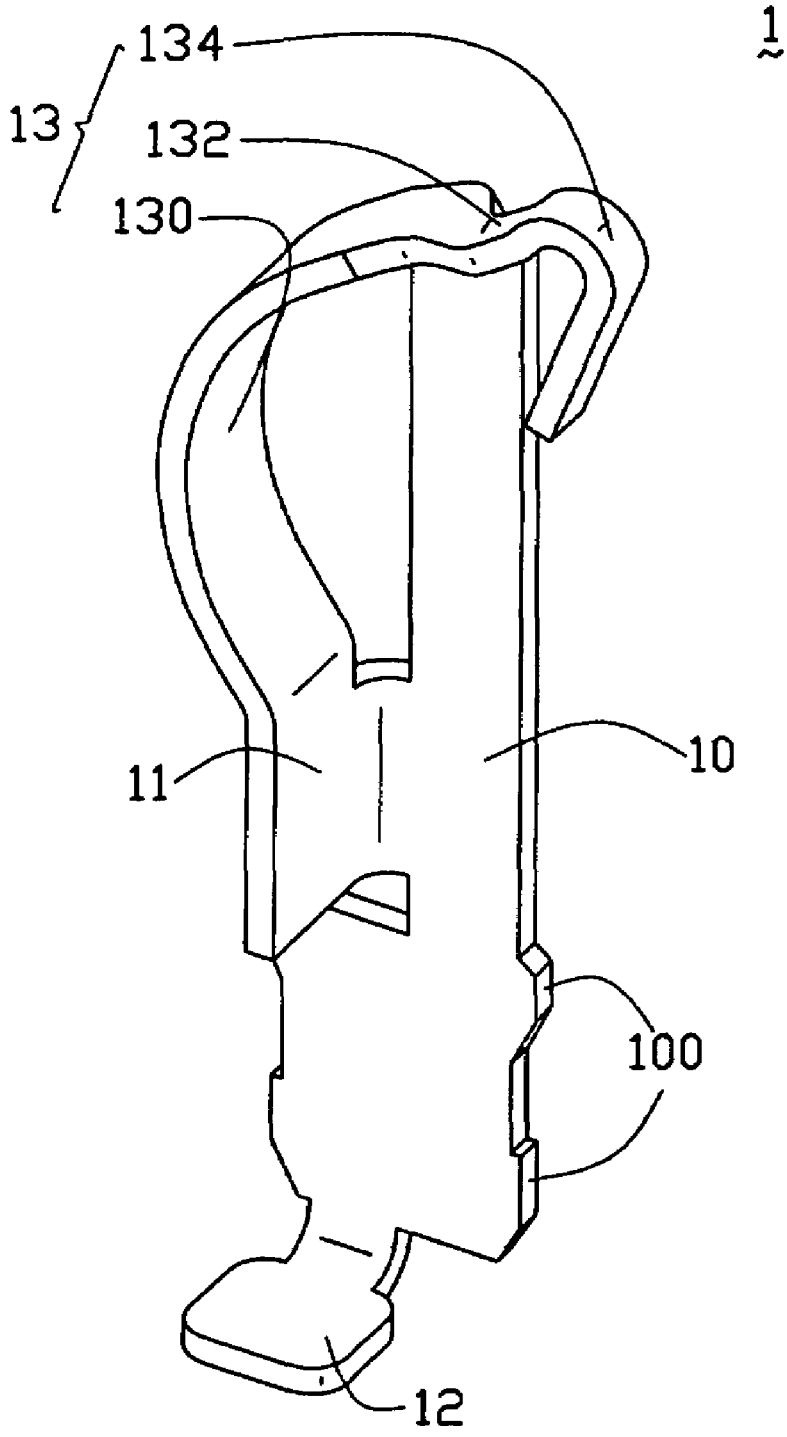
FIG. 1 is a perspective view of an electrical contact of a land grid array (LGA) socket in accordance with the present invention.
Figure 2:
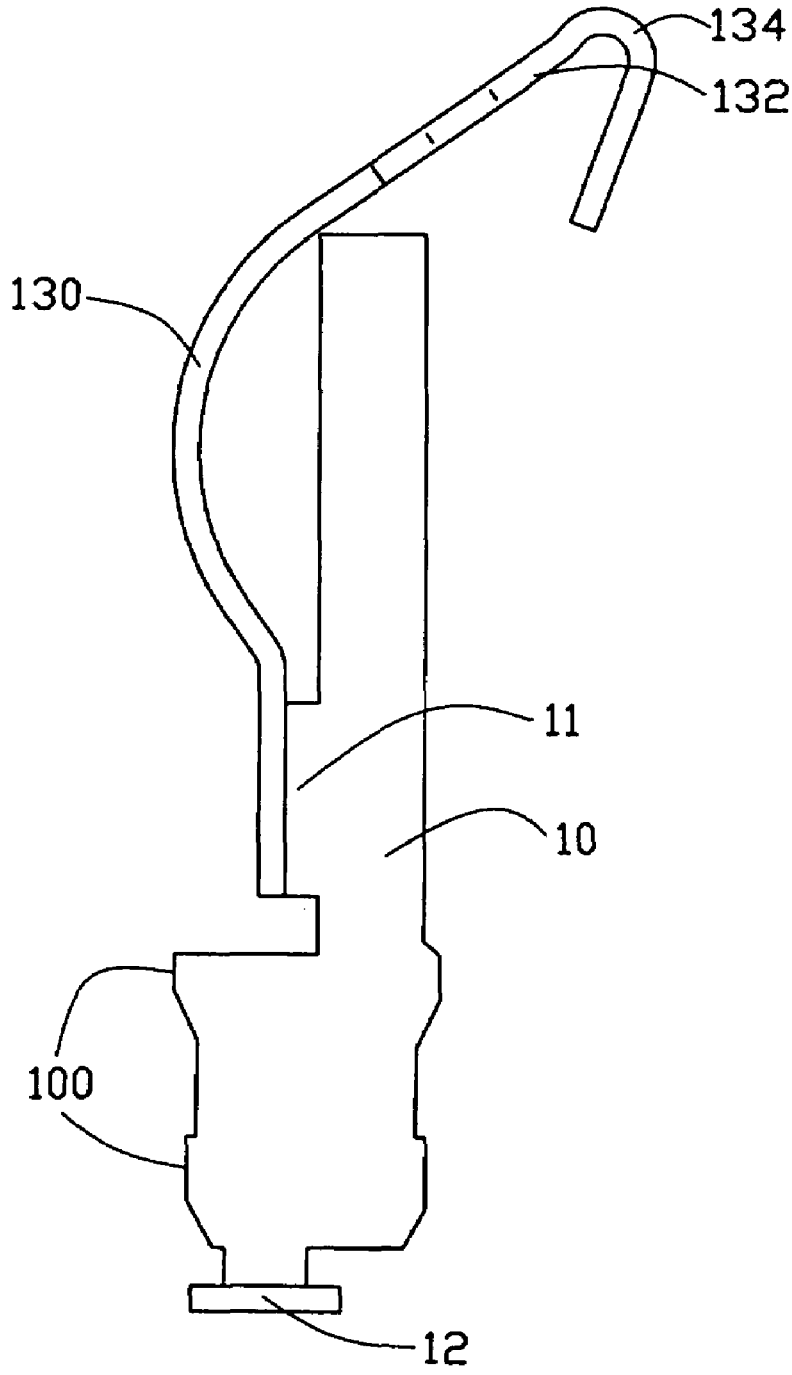
FIG. 2 is a front elevation view of the terminal of FIG. 1.
Figure 3:
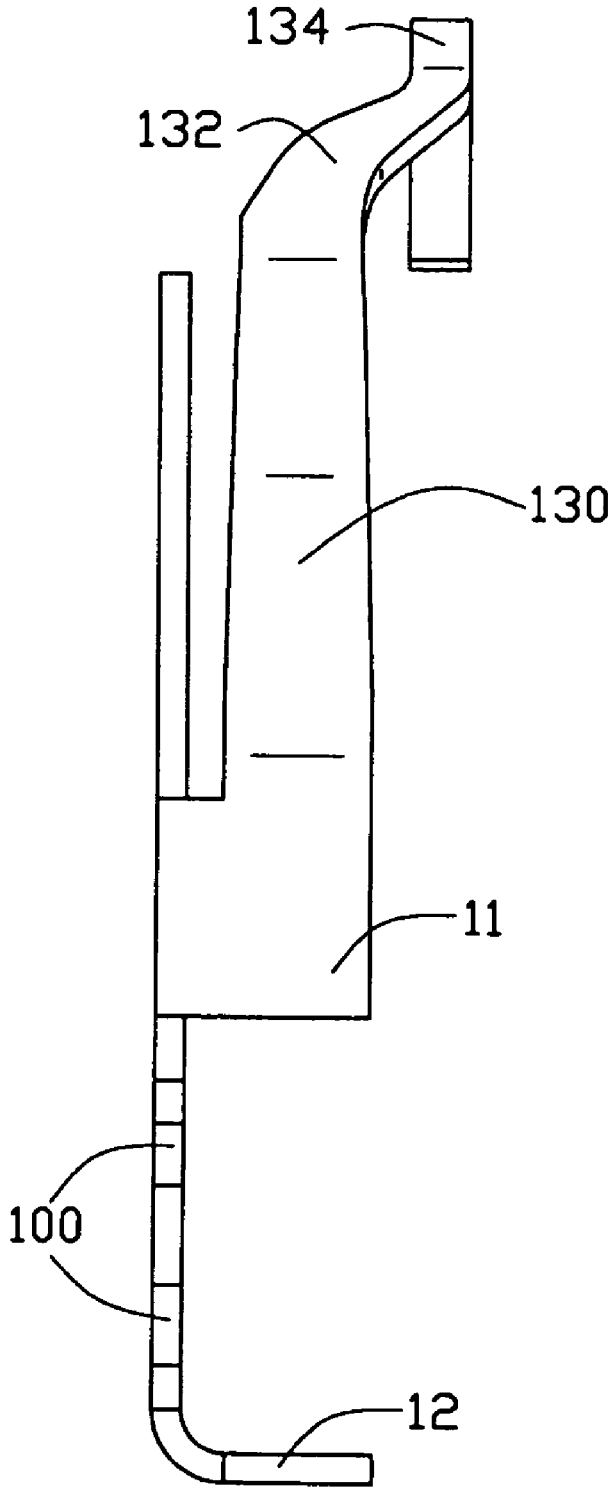
FIG. 3 is back elevation view of the terminal of FIG. 1.
Figure 4:
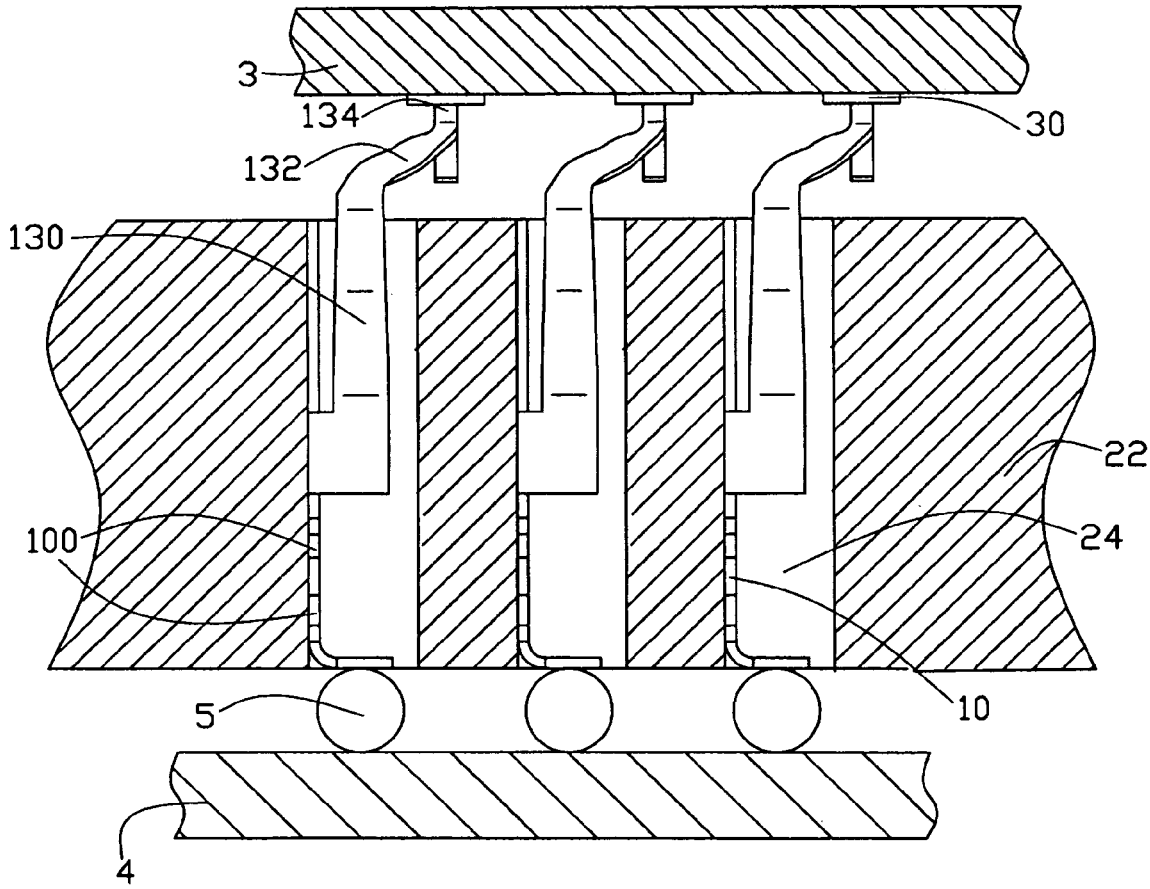
FIG. 4 is a cross-sectional view showing the terminals of FIG. 1 being received in passageways of an insulative housing of the LGA socket and connecting with two separate electronic components.
Figure 5:
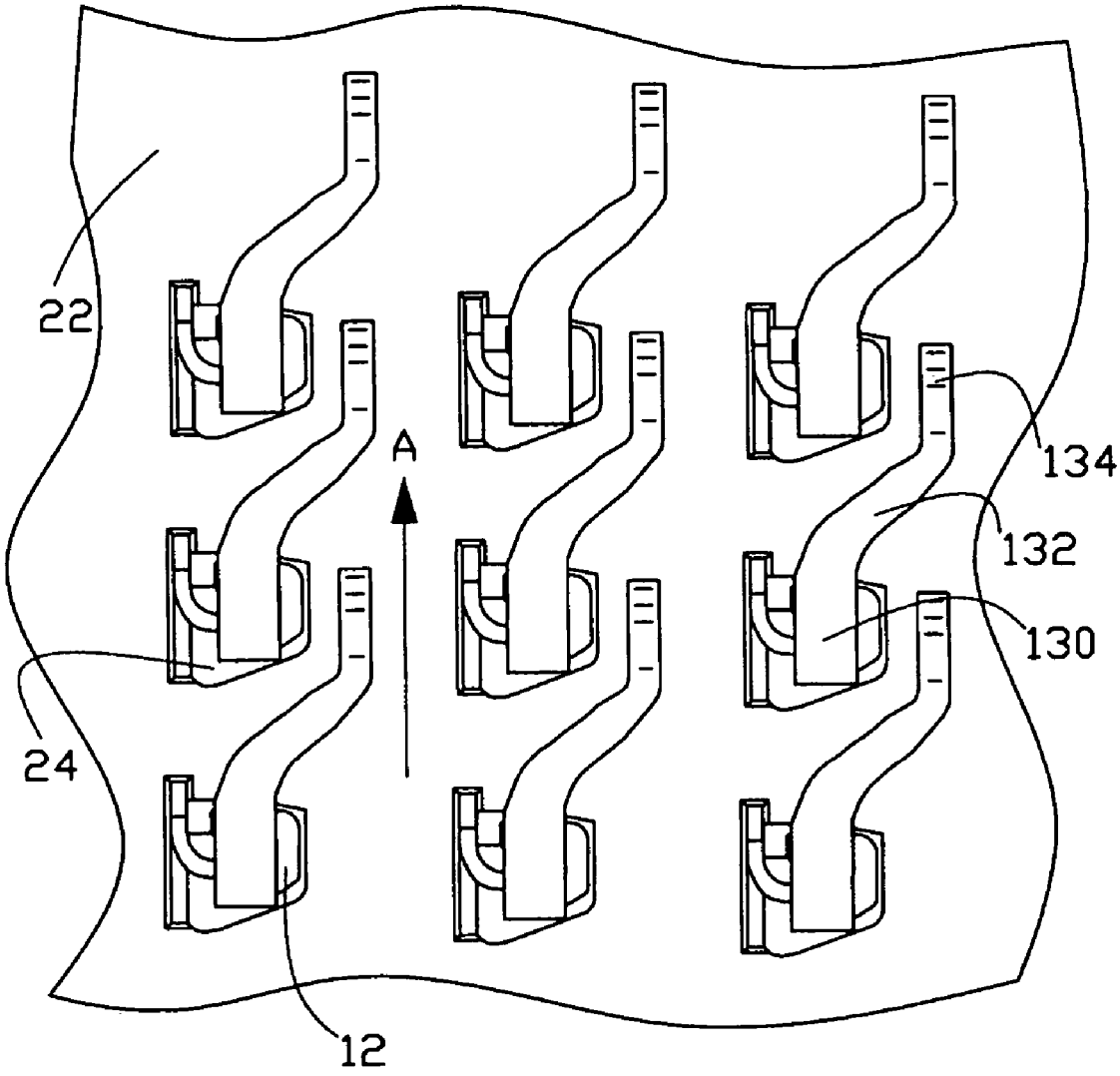
FIG. 5 is a top view showing relationship between two terminals in adjacent passageways of an insulative housing.

Referring to FIGS. 1 to 3, an electrical terminal 1 in accordance with the present invention is disclosed. Referring to FIGS. 4 and 5, a plurality of electrical terminal 1 as disclosed in FIGS. 1 to 3 are accommodated in corresponding passageways 24 of an insulative housing 22, respectively. The terminals 1 are arrayed in the housing 22 in rows such that the terminals 1 in a same row extends along a predetermined lateral direction "A". In this embodiment, the insulative housing 22 and the terminals 1 basically forms a land grid array (LGA) socket to electrically connect an IC chip 3 and a motherboard 4.

Referring to FIGS. 1 and 3, the terminal 1 comprises a base portion 10, a connecting portion 11, a solder portion 12 and a spring arm 13. The base portion 10 has a plurality of barbs formed in both sides thereof for securing the terminal 1 in the passageway 24. The connecting portion 11 extends laterally from one side of the base portion 10 and interconnects the base portion 10 and the spring arm 13. The solder portion 12 extends toward a bottom surface of the insulative housing 22 and soldered to a solder ball 5 (FIG. 4) so as to electrically connect the terminal 1 with the motherboard 4 via the solder ball 5. The spring arm 13 extends out of a top surface of the insulative housing 22 and electrically connects to a pad 30 of the IC chip 3.

The spring arm 13 comprises an extending portion 130, a bending portion 132 and a contacting end 134. The extending portion 130 is connected with the connecting portion 11 and extends upwardly from the connecting portion 11 in a slantwise manner with a part of the extending portion 130 being out of the top surface of the insulative housing 22, and a vertical extending direction of the extending portion 130 is parallel to the base portion 10 (FIG. 3) while a horizontal extending direction of the extending portion 130 is parallel to the lateral direction "A". The bending portion 132 is connected with the extending portion 130 and extends upwardly from the extending portion 130 in a slantwise manner, and a horizontal extending direction of the bending portion 132 is not parallel to the horizontal extending direction of the extending portion 130, i.e. there is an angle existed between the horizontal extending direction of the bending portion 132 and the lateral direction "A". Thus, one end of the bending portion 132 is away from the base portion 10. The contacting end 134 is connected with the bending portion 132 and extends upwardly toward the pad 30 of the IC chip 3, and a horizontal extending direction of the contacting end 134 is not parallel to the horizontal extending direction of the bending portion 132 but parallel to the lateral direction "A". Therefore, because of bend of the bending portion 132, a distance between the base portion 10 and the contacting end 134 is bigger than a distance between the base portion 10 and the extending portion 130.

Referring to FIG. 5, when the terminals 1 are received in the passageways 24, a contacting end 134 of a terminal 1 in a passageway 24 extends toward an adjacent passageway 24 in a same row along the lateral direction "A". Further, because of bend of the bending portion 132, the contacting end 134 is essentially located above a space of the adjacent passageway 24 but does not overlap with the terminal 1 in the adjacent passageway 24 along a vertical direction. As disclosed in the prior filed U.S. patent application Ser. No. 10/625,237 (FIGS. 8 and 9), two adjacent spring arms in the same row define a first vertical distance "C" therebetween in an initial position and define a second vertical distance "C'" therebetween in a final position, the second vertical distance is less than the first vertical distance. Correspondingly, the terminals 1 of the present invention also has this feature, when the terminals 1 are fully pressed down to their final position, a vertical distance between two adjacent spring arms 13 in the same row gets closer, but the two spring arms 13 do not overlap along the vertical direction because of bend of the bending portion 132. Thus, risk of short circuit between two adjacent terminals 1 are completely avoided.

A preferred embodiment in accordance with the present invention has been shown and described, It is noted that the extending direction of the contacting end 134 in this embodiment is parallel to the lateral direction "A". However, in another alternative embodiment, the extending direction of the contacting end 134 can be modified to have a predetermined angle relative to the lateral direction "A", if only the bending portion 132 is settled as a part of the terminal 1 to avoid overlapping of the adjacent terminals 1 in the same row. Therefore, equivalent modifications and changes known to persons skilled in the art according to the spirit of the present invention are considered within the scope of the present invention as defined in the appended claims.

What is claimed is:

1. An electrical connector comprising:

an insulative housing having a plurality of passageways formed therein, the passageways being arrayed in rows along a predetermined lateral direction;

a plurality of electrical terminals received in corresponding passageways, respectively; each terminal having a base portion and a spring arm extending out of the passageway from the base portion; the spring arm extending toward an adjacent passageway in a same row and partly located in a space essentially above the passageway, and the spring arm not overlapping with a spring arm of an electrical terminal in the adjacent passageway along a vertical direction;

wherein the spring arm comprises an extending portion which is connected to the connecting portion and partly extends out of the passageway parallel to the lateral direction; and wherein a bending portion is formed at one end of the extending portion, the bending portion extends away from the passageway in a direction being not parallel to the lateral direction.

2. The electrical connector of claim 1, wherein the spring arm is connected to the base portion via a connecting portion formed therebetween, and extends in the passageway from one side of the base portion.

3. The electrical connector of claim 1, wherein a contacting end is formed at one end of the bending portion and extending toward the adjacent passageway in a direction parallel to the lateral direction, and the contacting end does not overlap with the terminal in the adjacent passageway along the vertical direction.

4. The electrical connector of claim 1, wherein the terminal further comprises a solder portion extending out of a bottom surface of the insulative housing from the base portion opposite to the spring arm.

5. A land grid array socket for electrically connecting an IC chip to a motherboard, the socket comprising:

an insulative housing having a plurality of passageways arrayed in rows along a predetermined lateral direction, a plurality of electrical terminals received in corresponding passageways, respectively; each terminal has a spring arm extending out of the passageway from a base portion thereof, the spring arm comprising a bending portion extending toward an adjacent passageway in a same row in a direction being not parallel to the lateral direction and a contacting end formed at one end of the bending portion, the contacting end extending in a direction parallel to the lateral direction and invading a space beside the adjacent passageway;

wherein the contacting end of the spring arm does not overlap with a spring arm of a terminal in the adjacent passageway along a vertical direction.

6. The socket of claim 5, wherein the spring ann is connected to the base portion via a connecting portion formed therebetween, and partly extends out of the passageway from one side of the base portion.

7. The socket of claim 6, wherein the spring arm comprises an extending portion that is connected to the connecting portion and partly extends out of the passageway parallel to the lateral direction.

8. The socket of claim 5, the spring arm of the terminal can deflect from an initial position where the IC chip does not contact wit the spring arm to a final position where the IC chip is fully pressed down to the insulative housing.

9. The socket of claim 8, wherein the two adjacent spring arms in the same row define a first vertical distance therebetween in the initial position and define a second vertical distance therebetween in the final position, the second vertical distance being less than the first vertical distance.

10. The socket of claim 5, wherein the terminal further comprises a solder portion extending from the base portion opposite to the spring arm and being soldered to the motherboard.

11. An electrical connector comprising:

an insulative housing defining a plurality of passageways arranged in columns and rows;

a plurality of terminals disposed in the corresponding passageways, respectively, each of the terminals including a base portion, a spring arm upwardly extending above and away from the base portion and out of the corresponding passageway, the whole spring arm essentially defining an extending portion and a contacting end laterally offset from each other and connected by therebetween a bending portion angled with both said extending portion and said contacting end.

12. The electrical connector of claim 11, wherein the whole spring arm extends, from the top view, in a row direction, and said contacting end and said extending portion are parallel to each other in the top view.

13. The electrical connector of claim 12, wherein the extending portion is located at a root portion of the spring arm and essentially in the corresponding passageway from the top view; while the contacting end is located at a distal end of the spring arm and essentially outside of the corresponding passageway from the top view.

14. The electrical connector of claim 13, wherein a connecting portion extends from a lateral edge of the base portion to connect the spring arm and the base portion.

15. The electrical connector of claim 12, wherein the base portion defines a plane which is parallel to the row direction.

16. The electrical connector of claim 12, wherein the spring arm of the terminal is substantially horizontally parallel to, in said row direction, that of the adjacent terminal which is neighbored in said row direction.

17. The electrical connector of claim 16, wherein the contacting end of the terminal and that of the adjacent terminal which is neighbored along said row direction, is aligned, from the top view, with each other along said row direction.

18. The electrical connector of claim 12, wherein the contacting end extends, along said row direction, to reach an adjacent column from the top view.

19. The electrical connector of claim 18, wherein the contacting end is located between the adjacent two passageways in the adjacent column from the top view.

* * * * *